US006126212A

United States Patent [19]

Fujihara

[11] Patent Number: 6,126,212

[45] Date of Patent: Oct. 3, 2000

[54] ANTI-PANIC VEHICLE DOOR LATCH DEVICE

[75] Inventor: Yoshihiko Fujihara, Yamanashi-ken, Japan

[73] Assignee: Mitsui Kinzoku Kogyo Kabushiki Kaisha, Tokyo, Japan

[21] Appl. No.: 09/310,201

[22] Filed: May 12, 1999

[30] Foreign Application Priority Data

May 12, 1998 [JP] Japan ..... 10-146622
May 14, 1998 [JP] Japan ..... 10-150704

[51] Int. Cl.[7] ..... E05C 3/06

[52] U.S. Cl. ..... 292/216; 70/264

[58] Field of Search ..... 292/216, DIG. 23, 292/DIG. 27; 70/262, 264

[56] References Cited

U.S. PATENT DOCUMENTS 3,858,919 1/1975 Kleefeld ..... 292/216
4,005,887 2/1977 Itakura ..... 292/216
5,154,460 10/1992 Bartsch ..... 292/336.3
5,181,754 1/1993 Shibata ..... 292/216
5,653,484 8/1997 Brackmann ..... 292/216
5,803,515 9/1998 Arabia ..... 292/216

*Primary Examiner*—Neill Wilson
*Assistant Examiner*—Gary Estremsky
*Attorney, Agent, or Firm*—Browdy and Neimark

[57] ABSTRACT

A vehicle door latch device comprises a connecting member for connecting a lock pin with a lock lever. The connecting member has a lever side member connected to a lock lever, a pin side member connected to a lock pin, and a connecting spring for elastically connecting the lever side member with the pin side member. The connecting member changes length thereof against the elasticity of the spring to allow the lock lever to be displaced to an unlocked position from a locked position, when the lock pin cannot be displaced from a disengagement position to an engagement position by a displacement of the lock lever from a locked position toward an unlocked position while the open lever is in a door-opening position.

3 Claims, 9 Drawing Sheets

19
2
18
20
5
3
17
Y
Z
X
16
15
1
8
4
11
6
9
21
24
12
10
7
16A
25
23
22
T
W
S
13
14
16B

ANTI-PANIC VEHICLE DOOR LATCH DEVICE

BACKGROUND OF THE INVENTION

The present invention relates to a vehicle door latch device, and more particularly, to an anti-panic door latch device.

FIGS. 12 and 13 show a typical conventional vehicle door latch device. The conventional device comprises a latch A which is engageable with a striker B fixed to a vehicle body, a ratchet C which holds engagement of the latch A with the striker B by engaging with the latch A, a ratchet lever D which rotates with the ratchet C as one-piece, an open lever E which rotates from an initial position S to a door-opening position T in response to operation of a door-opening handle O of a vehicle door, a lock pin G which is slidably engaged with a slot F of the open lever E and moves in a given direction W by rotation of the open lever E, a lock lever H which is connected to a lock button P of the door and is displaceable between an unlocked position X and a locked position Y, an over-center spring J which holds the lock lever H by elasticity thereof at either the unlocked position X or the locked position Y with respect to a dead-center point Z thereof, and a connecting member K which connects the lock pin G and the lock lever H.

When displacing the lock lever H to the unlocked position X, the connecting member K moves the lock pin G within a concave portion L of the ratchet lever D, and when displacing the lock lever H to the locked position Y, the connecting member K moves the lock pin G outside the concave portion L.

A problem to be solved of the above prior art device is that when the opening handle O is operated to open the door in the locked state shown in FIG. 12, it becomes impossible to restore the lock lever H to the unlocked position X from the locked position Y. This state is often called a panic state of the door latch device. The panic state will be described in detail. In the locked state shown in FIG. 12, when the open lever E is displaced to the opening position T by the opening handle O, the lock pin G is shifted in the given direction W. However, at this moment, the door is not opened since the door is in the locked state. In this state where the open lever E is in the opening position T, when the lock button P is operated to unlock the latch device, the connecting member K is moved upward by counterclockwise rotation of the lock lever H, and the lock pin G is then brought into contact with a contact portion M of the ratchet lever D before the lock lever H goes over the dead-center point Z of the spring J. Thereby, further unlocking rotation of the lock lever H becomes impossible, and the door latch device remains locked. This state is a panic state of the door latch device.

In the above panic state, since the lock lever H is positioned between the locked position Y and the dead-center point Z, the lock lever H will be restored to the locked position Y by the elasticity of the over-center spring J when an operator releases his hold from the lock button P. In the prior art door latch device, when the panic state arises, it is necessary to move the lock button P in the unlocking direction again after restoring the open lever E to the initial position S, in order to unlock the door lath device.

U.S. Pat. No. 5,181,754 discloses another type of door latch device which also has the same problem. In this device, when an open lever (29) is rotated up to the door-opening position, a connecting member (33) is moved downward in FIG. 5 of the prior art, and an unnumbered bent portion adjacent to a lock pin (42) is engageably opposed to a contact portion (10) of a ratchet (6). In this state, when the lock button is operated to unlock the latch device, the connecting member (33, 39) is moved rightward by counterclockwise rotation of a lock lever (35), and the unnumbered bent portion is brought into contact with the contact portion (10) before the lock lever (35) goes over the dead-center point of a over-center spring. Thereby, unlocking of the prior art door latch device meets with failure.

SUMMARY OF THE INVENTION

Accordingly, it is an object of the present invention to provide an anti-panic vehicle door latch device in which a second unlocking operation of a lock button is unnecessary even if a panic state arises.

DESCRIPTION OF THE PREFERRED EMBODIMENT

Figure 4:
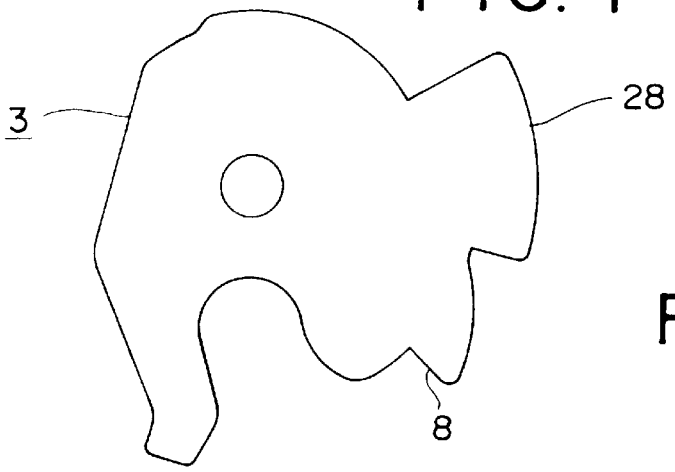
FIG. 4 is a front view of a latch of the door latch device.
Figure 5:
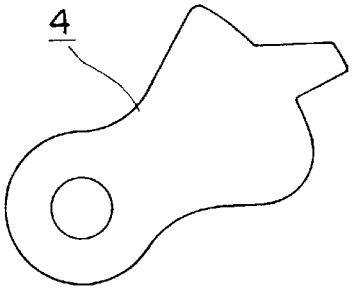
FIG. 5 is a front view of a ratchet of the door latch device.

One example of the present invention will be described by referring to drawings. A latch device according to the present invention comprises a striker 1 attached to a vehicle body (not shown) and a latch unit 2 attached to a vehicle door (not shown). The latch unit 2 comprises a well known latch 3 (FIG. 4) engageable with the striker 1 and a well known ratchet 4 (FIG. 5). The latch 3 is rotatably attached to a latch shaft 5, and the ratchet 4 is rotatably attached to a ratchet shaft 6. The ratchet 4 holds an engagement of the latch 3 with the striker 1 by engaging with a shoulder portion 8 of the latch 3 by elasticity of a ratchet spring 7 so as to keep the door in a door-closed state.

Figure 6:
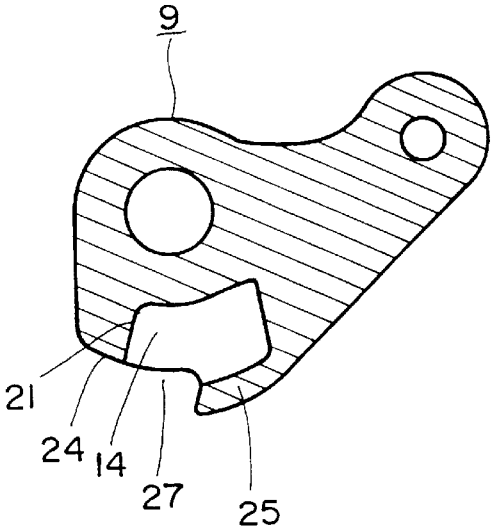
FIG. 6 is a cross sectional view of a ratchet lever of the door latch device.

A ratchet lever 9 (FIG. 6) pivoted to the ratchet shaft 6 is connected to the ratchet 4 by a ratchet pin 10. The ratchet lever 9 has a concave portion 14 into which a lock pin 13 slidably engaged with a slot 12 of an open lever 11 can come. The open lever 11 is connected to an opening handle 15 of the door. The open lever 11 is rotated from an initial position S to a door-opening position T by an opening operation of the handle 15, and the rotation of the open lever 11 causes the lock pin 13 to displace in a door-opening direction W through the slot 12. The lock pin 13 is provided at a lower end of a longitudinally elongated connecting member 16, and an upper end of the connecting member 16 is connected to a lock lever 18 with a mounting pin 17. The lock lever 18 is connected to a key cylinder and/or an inside lock button 19 of the door.

The lock lever 18 is held at either an unlocked position X or a locked position Y by elasticity of an over-center spring 20 with respect to a dead-center point Z of the spring 20 as a boundary. When displacing the lock lever 18 to the unlocked position X against the elasticity of the spring 20, the connecting member 16 moves the lock pin 13 upward to make it come into the concave portion 14, and then the door latch device becomes in the unlocked state. In this unlocked state, when rotating the open lever 11 from the initial position S to the opening position T, the lock pin 13 is shifted in the opening direction W to come into contact with a side wall 21 of the concave portion 14, and the ratchet lever 9 is then rotated clockwise, thereby the ratchet 4 is released from the latch 3 so as to open the door.

Figure 1:
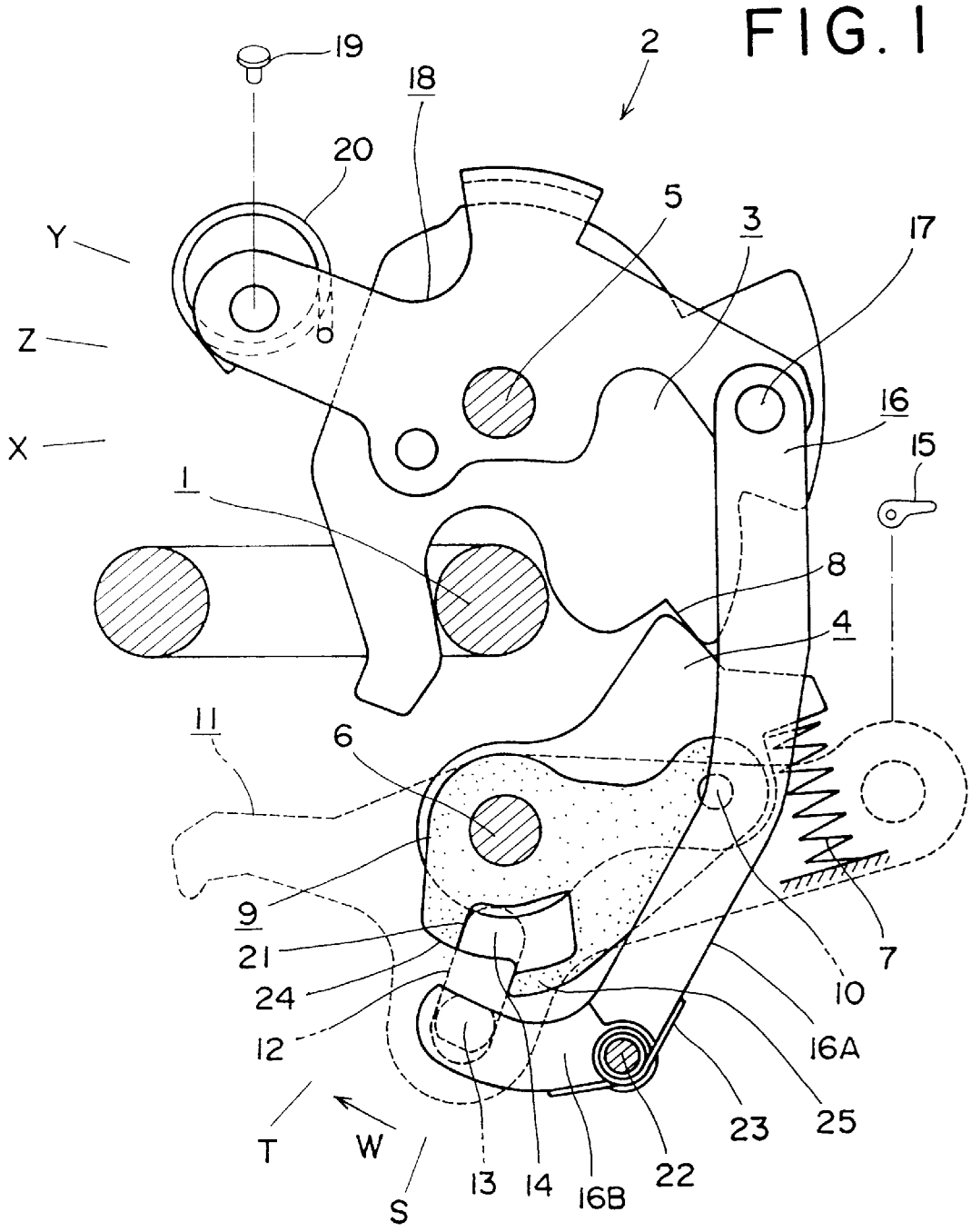
FIG. 1 is a front view showing door-closed and locked states of a door latch device according to the present invention.

When displacing the lock lever 18 to the locked position Y, the lock pin 13 is moved to the lower portion of the slot 12 as shown in FIG. 1 and released from the concave portion 14. In this locked state, even if the open lever 11 is displaced to the opening position T, the lock pin 13 cannot rotate the ratchet lever 9, and therefore, the door is not opened.

Figure 7:
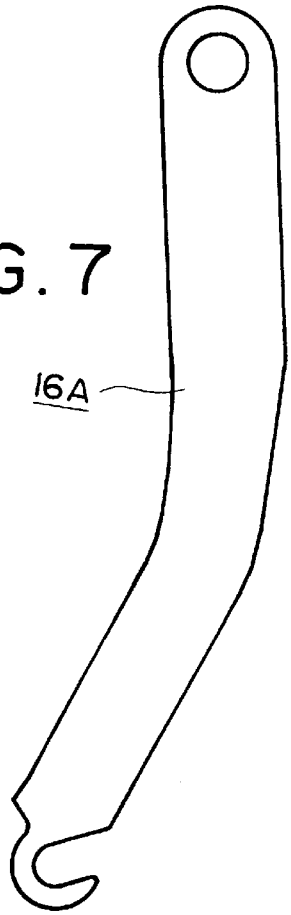
FIG. 7 is a front view of a lever side member of a connecting member of the door latch device.
Figure 8:
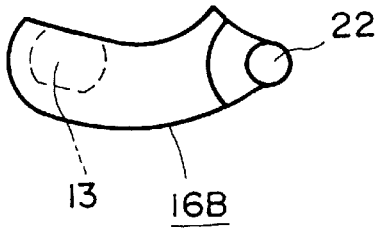
FIG. 8 is a front view of a pin side member of the connecting member of the door latch device.

The connecting member 16 comprises a lever side member 16A (FIG. 7) connected to the lock lever 18 by the mounting pin 17 and a pin side member 16B (FIG. 8) having the lock pin 13. The pin side member 16B is rotatably attached to the lever side member 16A by a connecting pin 22. Between the member 16A and the member 16B is provided a connecting spring 23 for relatively urging the pin side member 16B in the clockwise direction in FIG. 1. The connecting member 16 usually has an approximate L-shape since the pin side member 16B comes into contact with the lever side member 16A by the resilient force of the spring 23. The distance between the mounting pin 17 and the lock pin 13 becomes longer when the pin side member 16B rotates counterclockwise against elasticity of the spring 23.

In the locked state shown in FIG. 1, when the open lever 11 is rotated up to the door-opening position T by the opening handle 15, the lock pin 13 is shifted in the opening direction W. However, at this moment, the door is not opened. In this state, when the lock button 19 is operated to unlock, the connecting member 16 is moved upward by the counterclockwise rotation of the lock lever 18. Then, the lock pin 13 is also moved upward by being guided by the slot 12 of the open lever 11 to come into contact with a contact portion 24 of the ratchet lever 9. This state is a panic state of the door latch device. At this moment, the lock lever 18 is positioned between the locked position Y and the dead-center point Z.

Figure 3:
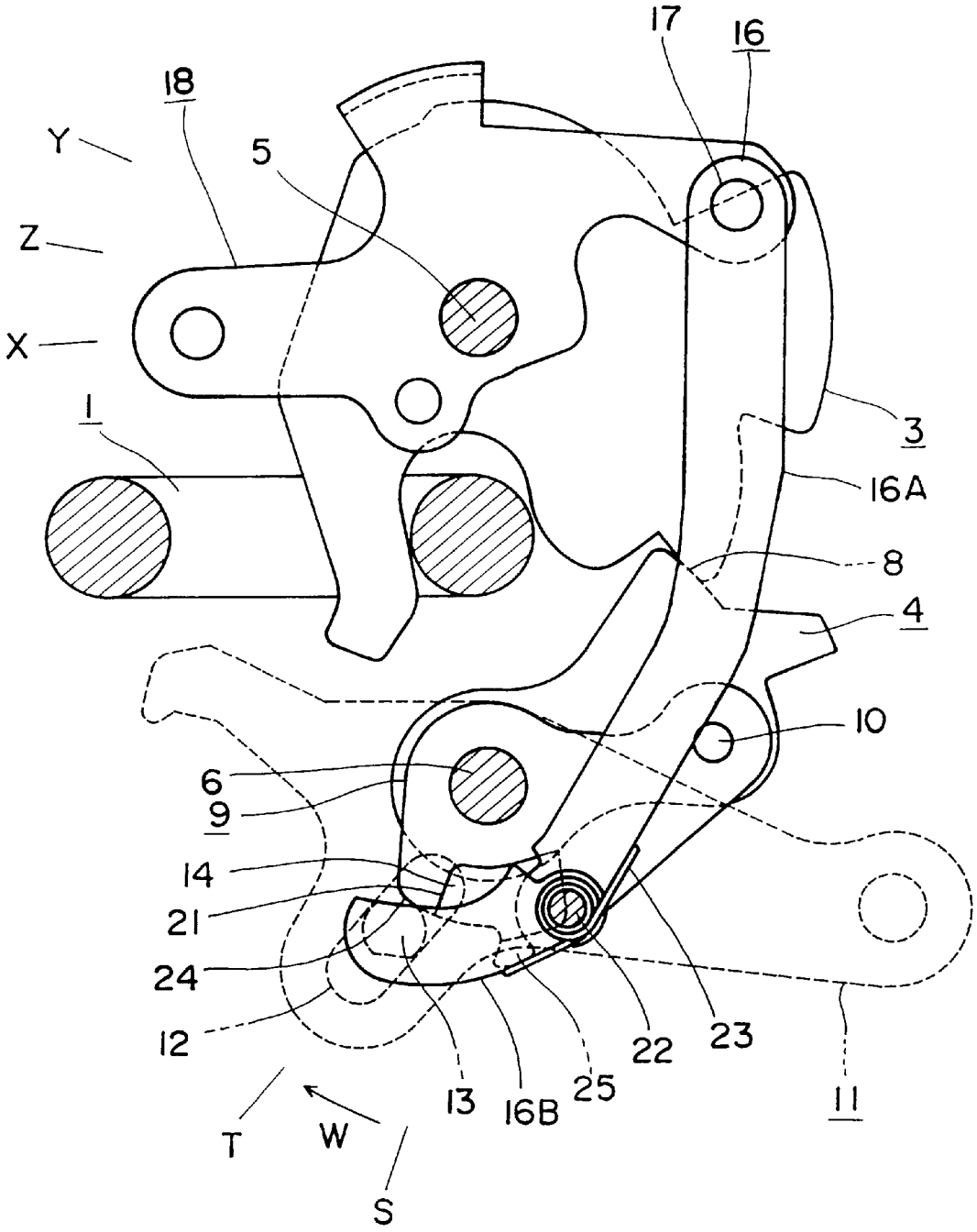
FIG. 3 is a front view showing a panic state of the door latch device.

In the panic state where the lock pin 13 is in contact with the contact portion 24 of the ratchet lever 9, when further rotating the lock lever 18 in the unlocking direction using the lock button 19, the pin side member 16B is rotated counterclockwise relative to the lever side member 16A against the elasticity of the connecting spring 23 by contact of the lock pin 13 with the contact portion 24, and then the distance between the mounting pin 17 and the lock pin 13 becomes longer, as shown in FIG. 3, thereby the lock lever 18 goes over the dead-center point Z by unlock operation of the lock button 19 so as to be displaced to the unlocked position X.

Figure 2:
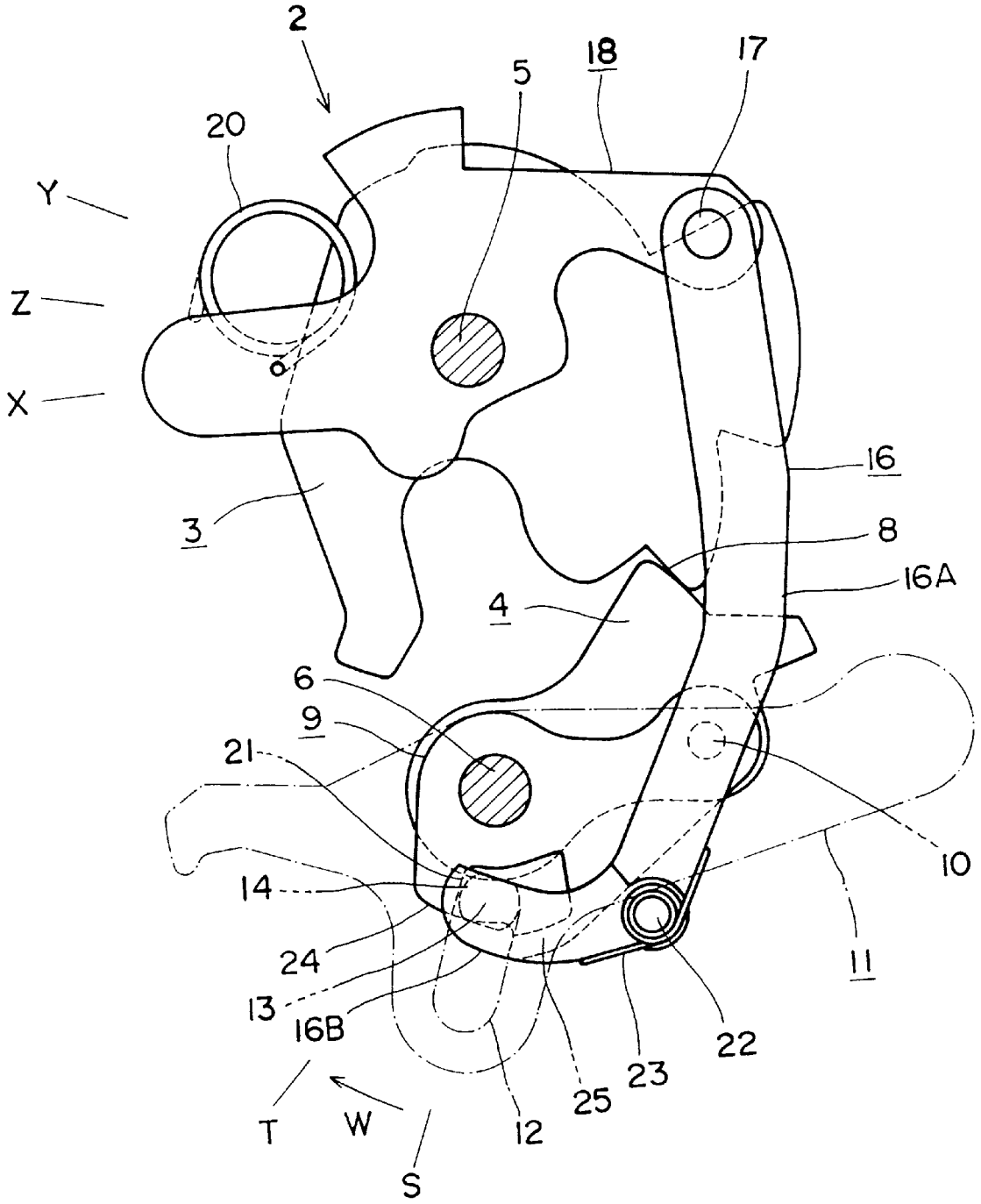
FIG. 2 is a front view showing door-closed and unlocked states of the door latch device.

In the state of FIG. 3, the lock lever 18 is in the unlocked position X, but the lock pin 13 is positioned outside the concave portion 14. Therefore, the door latch device is still held in the locked state. However, in the present invention, when an operator releases his hold from the door-opening handle 15 to restore the open lever 11 from the opening position T to the initial position S, the lock pin 13 is shifted in the direction opposite to the opening direction W to stand opposite to the concave portion 14. Then, the pin side member 16B is rotated clockwise by elasticity of the spring 23, and the lock pin 13 comes into the concave portion 14, thereby the door latch device is restored in the unlocked state of FIG. 2.

Thus, in the present invention, the lock pin 13 is engaged with the concave portion 14 by restoring the open lever 11 to the initial position S, and consequently, the second unlocking operation of the lock button required in the prior art device for releasing the panic state, is unnecessary.

As mentioned above, the distance between the mounting pin 17 and the lock pin 13 of the connecting member 16 of the present invention becomes longer when the panic state arises. Because the connecting member 16 pulls the lock pin 13 when the lock lever 18 is rotated toward the unlocked position X. Therefore, in the composition where the connecting member pushes the lock pin to unlock the latch device, the distance must become shorter when the panic state arises. Accordingly, it is important for the connecting member 16 that length thereof is elastically changed when the panic state arises. Furthermore, it is also possible to use a sliding mechanism, a dovetail groove mechanism, and the like as a connecting means of the member 16A with the member 16B.

Figure 9:
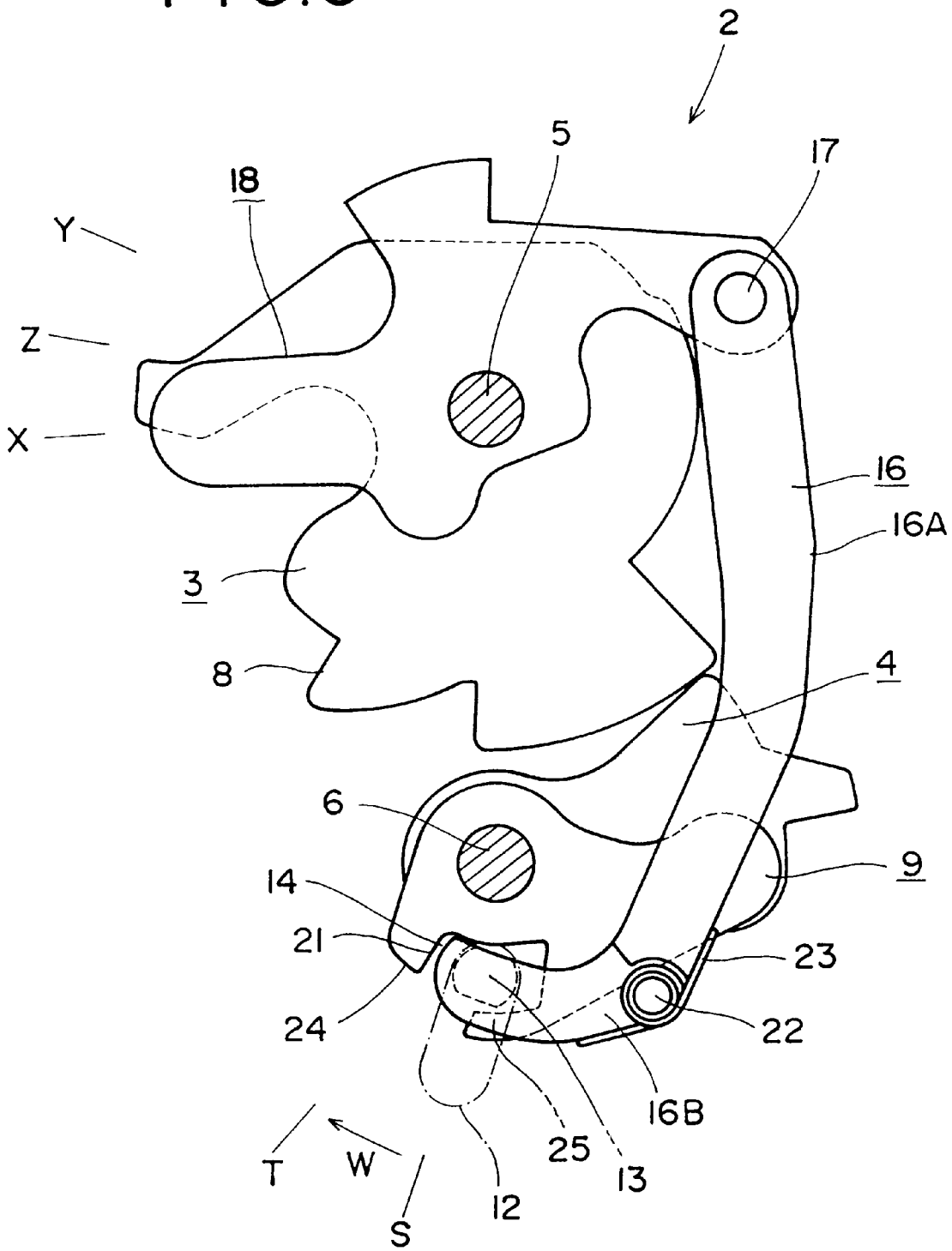
FIG. 9 is a front view showing door-opened and unlocked states of the door latch device.
Figure 10:
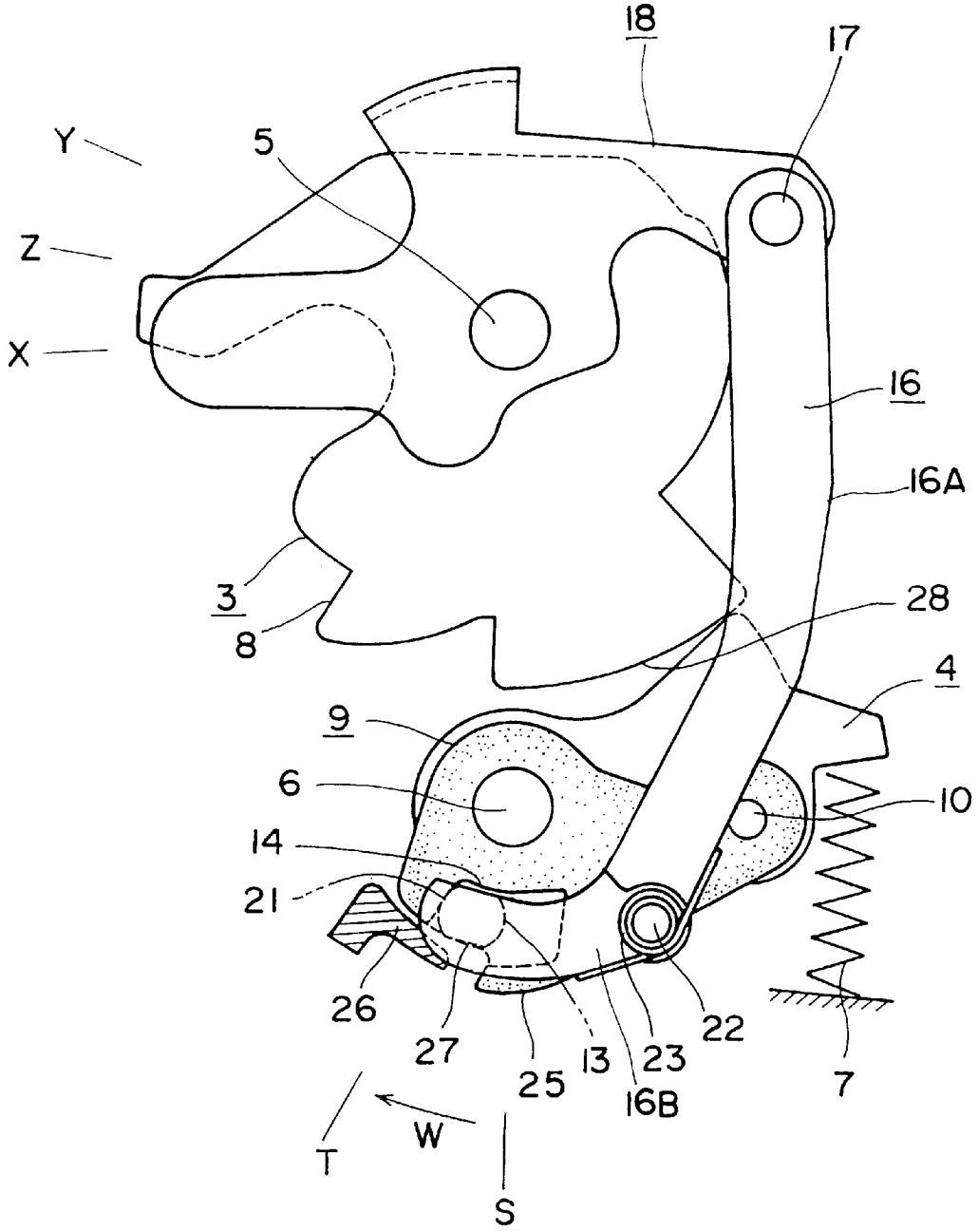
FIG. 10 is a front view of the door latch device provided with a sub block portion.

FIG. 9 shows the door-opened state of the latch unit 2 in which the ratchet 4 is brought into contact with an unlatching portion 28 of the latch 3 and the ratchet lever 9 is rotated clockwise from the position of FIG. 1. The ratchet lever 9 has a main block portion 25 which is shifted to a position beneath the lock pin 13 when the door is in the opened and unlocked states. The block portion 25 precludes the lock pin 13 from getting out of the concave portion 14 in response to the locking operation of the lock button 19, and therefore, it is impossible to displace the lock lever 18 to the locked position Y in the door-opened state. Restriction by the main block portion 25 can be released as shown in FIG. 10 when the open lever 11 is rotated toward the door-opening position T to shift the lock pin 13 in the opening direction W. Accordingly, when shifting the door latch device to the locked state in the door-opened state, the opening operation of the opening handle 15 is required. Such an additional operation may prevent operational error of the driver for unintentionally locking the latch device. However, it is impossible to completely prevent the wrong locking by only the additional operation which is required by the main block portion 25.

Figure 11:
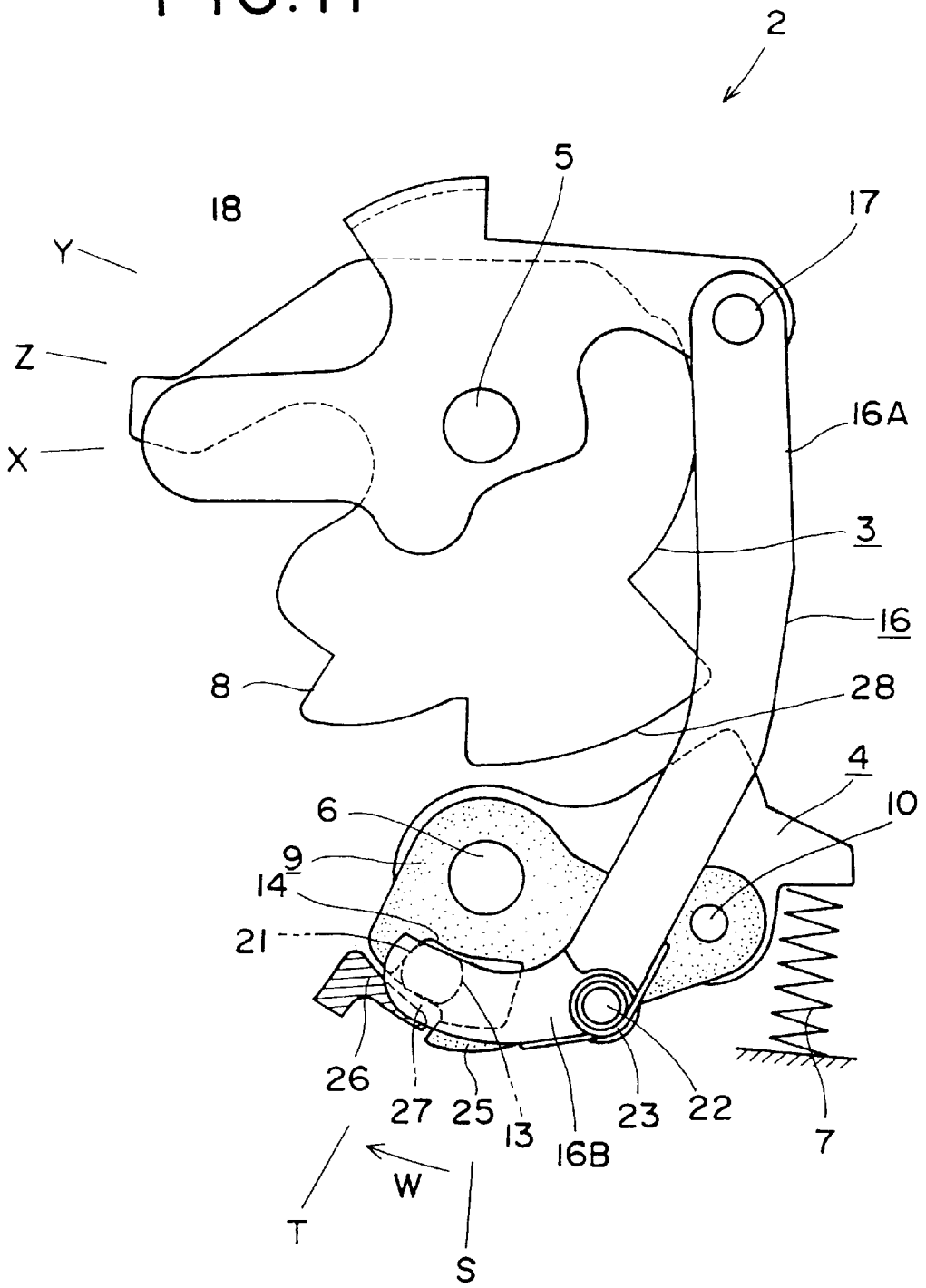
FIG. 11 is a front view showing a state where an open lever in FIG. 10 has been rotated up to a door-opening position.
Figure 12:
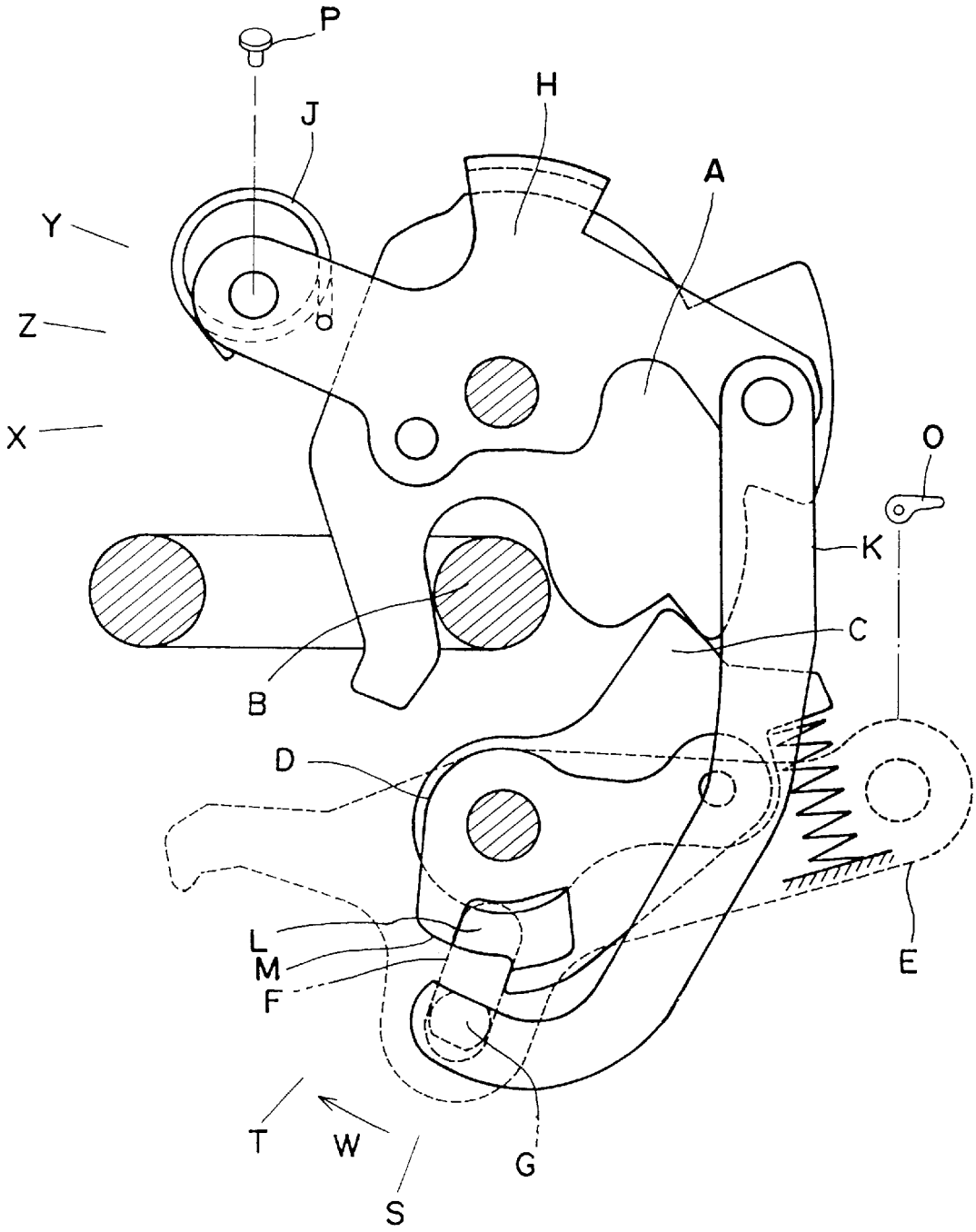
FIG. 12 (PRIOR ART)
FIG. 12 is a front view showing door-closed and locked state a conventional door latch device.
Figure 13:
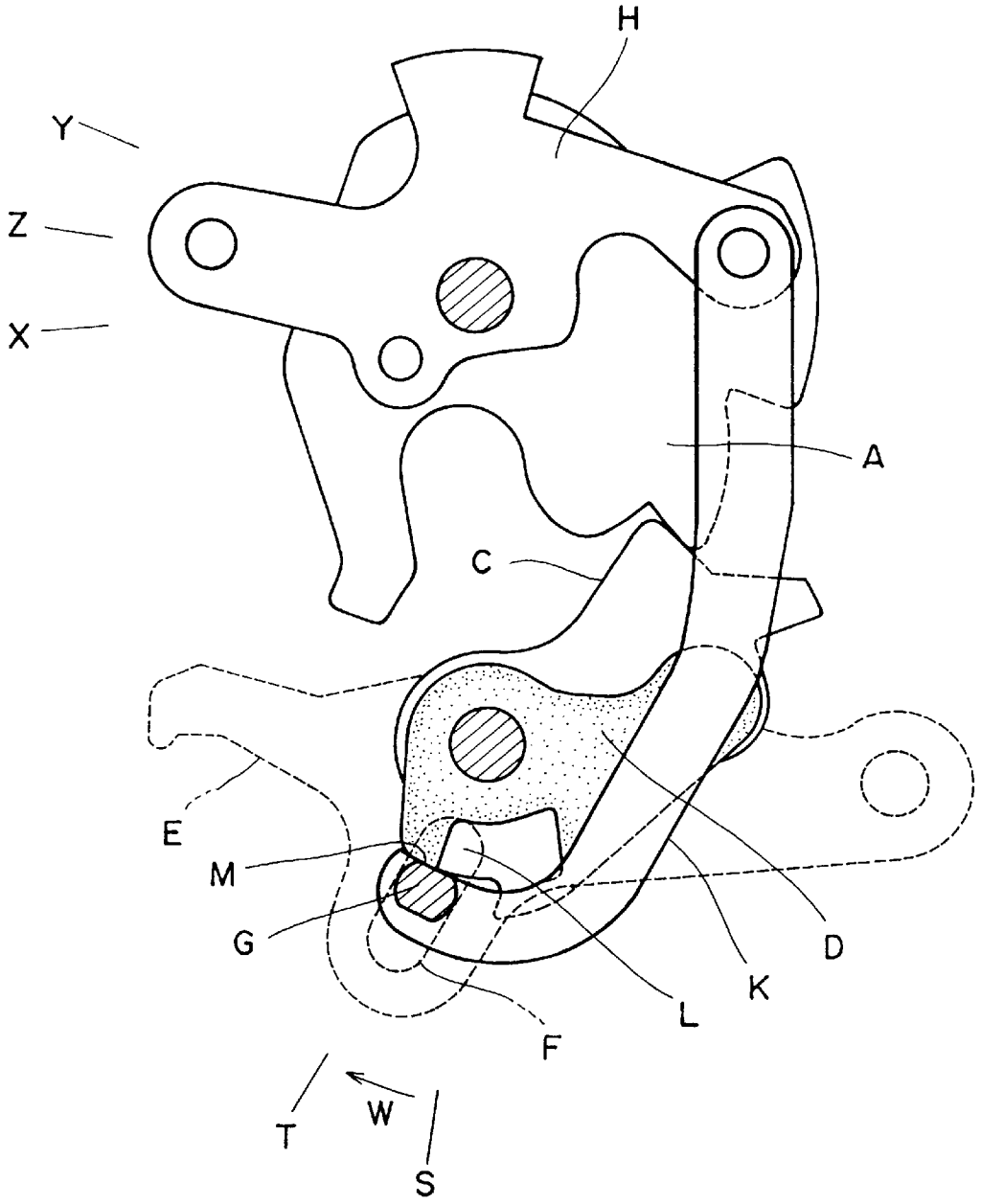
FIG. 13 (PRIOR ART)
FIG. 13 is a front view showing door-closed and unlocked states of the conventional door latch device.

As shown in FIGS. 10 and 11, a door latch device of the second embodiment in accordance with the present invention has a sub block portion 26 to prevent the wrong locking operations. The sub block portion 26 is provided on a latch body (not shown), and closes an opening portion 27 of the concave portion 14 of the ratchet lever 9 when the ratchet lever 9 is rotated in the direction W by contact between the ratchet 4 and the unlatching portion 28. Accordingly, in the door latch device of the second embodiment, even if the lock pin 13 is shifted in the door-opening direction W by door-opening rotation of the open lever 11, it is impossible to displace the lock lever 18 from the unlocked position X to the locked position Y.

What is claimed is:

1. A vehicle door latch device comprising:

a latch engageable with a striker fixed to a vehicle body;

a ratchet for holding an engagement between the latch and the striker by engaging with the latch;

an open lever rotatable from an initial position to a door-opening position by an operation of a door-opening handle of a vehicle door;

a lock pin movable in a given direction when the open lever is rotated from the initial position to the door-opening position;

a lock lever adapted to be connected to a lock button of the door and displaceable between an unlocked position and a locked position;

an over-center spring for holding the lock lever by elasticity thereof at either the unlocked position or the locked position with respect to a dead-center point thereof;

a connecting member shifting the lock pin to an engagement position in which a movement of the ratchet when the lock lever is displaced to the unlocked position, and said connecting member shifting the lock pin to a disengagement position in which the movement of the lock pin in the given direction cannot be transmitted to the ratchet when the lock lever is displaced to the locked position;

wherein said connecting member has a lever side member connected to the lock lever, a pin side member connected to the lock lever, a pin side member connected to the lock pin, and a connecting spring for elastically connecting the lever side member with the pin side member;

wherein said connecting member changes length thereof against elasticity of the connecting spring to allow the lock lever to be displaced to the unlocked position from the locked position, when said lock pin cannot be displaced from the disengagement position to the engagement position by a displacement of the lock lever from the locked position toward the unlocked position while said open lever is in the door-opening position; and the vehicle door latch device further comprising a main block portion for preventing the lock pin from being shifted from the engagement position to the disengagement position when said ratchet is in contact with an unlatching portion of the latch and said open lever is in the initial position, and a sub block portion for preventing the lock pin from being shifted from the engagement position to the disengagement position when said ratchet is in contact with the unlatching portion and said open lever is in the door-opening position.

2. The vehicle door latch device according to claim 1, wherein said lock pin is shifted from the disengagement position to the engagement position by the elasticity of the connecting spring, when said open lever is restored from the door-opening position to the initial position.

3. The vehicle door latch device according to claim 1, further comprising a ratchet lever rotated with the ratchet as one piece, wherein said ratchet lever has a concave portion with which said lock pin positioned in the engagement position is engaged and said main block portion, wherein one side of said concave portion is closed by the main block portion excluding an opening portion through which the lock pin passes, and wherein said sub block portion is arranged at a position to close the opening portion of the concave portion when said ratchet is in contact with the unlatching portion of the latch.

* * * * *